US005531347A

United States Patent [19]

Goulding

[11] Patent Number: 5,531,347

[45] Date of Patent: Jul. 2, 1996

[54] PASTRY SUPPORTING CUP COVER

[76] Inventor: Charles T. Goulding, 5100 Mountain Top Rd., New Hope, Pa. 18938

[21] Appl. No.: 405,730

[22] Filed: Mar. 17, 1995

[51] Int. Cl.[6] ..... B65D 51/18

[52] U.S. Cl. ..... 220/256; 215/309; 215/310; 215/387; 220/711; 220/712; 220/713; 220/352

[58] Field of Search ..... 220/711, 712, 220/713, 254, 256, 259, 265, 266, 352, 356, 724; 215/307, 309, 310, 354, 387

[56] References Cited

U.S. PATENT DOCUMENTS

| | | | |
|---|---|---|---|
| 1,467,578 | 9/1923 | Gianini | 215/231 |
| 2,756,793 | 7/1956 | Tupper | 220/352 X |
| 2,851,713 | 9/1958 | Tupper | 220/306 X |
| 2,944,273 | 7/1960 | Harris | 220/306 X |
| 3,131,824 | 5/1964 | Van Baarn | 215/43 X |
| 3,537,422 | 11/1970 | Moe | 220/525 X |
| 3,587,944 | 6/1971 | Pehr | 220/256 X |
| 3,994,411 | 11/1976 | Elfelt et al. | 220/712 |
| 4,084,695 | 4/1978 | Halbich | 220/525 X |
| 4,331,255 | 5/1982 | Fournier | 220/713 X |
| 4,333,583 | 6/1982 | Montemarano | 220/712 |
| 4,741,450 | 5/1988 | Braude | 220/712 |
| 5,115,950 | 5/1992 | Rohr | 220/259 X |
| 5,150,803 | 9/1992 | Cartellone | 220/254 X |
| 5,348,181 | 9/1994 | Smith et al. | 220/711 X |
| 5,353,985 | 10/1994 | Nageli et al. | 220/524 X |

*Primary Examiner*—Allan N. Shoap
*Assistant Examiner*—Robin A. Hylton
*Attorney, Agent, or Firm*—Eric A. LaMorte

[57] ABSTRACT

A lid for a disposable hot beverage container that is specifically designed to hold a pastry over the hot beverage. This enables the steam from the beverage to heat, flavor and moisten the pastry. The lid includes an engagement mechanism that enables the lid to be selectively joined to the rim of the hot beverage container. The lid has a plurality of apertures formed through its base structure that enable steam from the beverage to rise through the lid. A plurality of supports extend upwardly from the base structure. The supports all terminate in a common plane a predetermined height above the base structure. The supports hold the pastry a predetermined distance above the base structure of the lid. As a result, if liquid were to spill onto the lid, or if steam were to condense onto the lid, the pastry would be supported above the liquid and would be saved from becoming soggy.

17 Claims, 5 Drawing Sheets

PASTRY SUPPORTING CUP COVER

BACKGROUND OF THE INVENTION

1. Field of the Invention

The present invention relates to disposable covers for hot beverage containers such as coffee cups. More particularly, the present invention relates to cup covers with perforated contoured surfaces that are capable of supporting a pastry above a hot beverage so that the steam from the hot beverage can heat and moisten the pastry.

2. Prior Art Statement

Numerous restaurants, convenience stores, donut shops, vending machines and the like serve hot beverages, such as coffee, tea, hot chocolate and so forth, in disposable cups. This enables the customer to take the hot beverage with them in their travels. Such disposable cups are typically constructed of paperboard, plastic or styrofoam and are adapted to receive lids that prevent the contents of the cup from spilling as the cup is moved.

It is a popular breakfast tradition for people to eat a donut, danish or other pastry with their morning coffee or tea. Many people dunk their pastries in their coffee or tea prior to consumption. In an attempt to keep their pastry warm and fresh, many people attempt to balance the pastry on the rim of the cup so that part of the pastry overhangs the hot coffee or tea within their cup. This allows the steam from the hot beverage to contact the pastry, thereby both warming and moistening the pastry. The obvious problem with balancing a pastry on the rim of a cup is that often the pastry falls into the cup ruining both the beverage and the pastry. This is particularly a problem when a person attempts to move the cup. Furthermore, balancing a pastry on the edge of a cup is nearly impossible in a moving vehicle. Even under ideal conditions, problems occur in balancing a pastry because as the pastry is eaten, the smaller and smaller sized pastry becomes more and more difficult to balance on the edge of a cup.

From the above, it can be seen that it is very difficult to move a hot beverage cup with a pastry balanced on its rim. As such, the pastry must first be removed prior to the movement of the cup. But even without the pastry, hot beverage cups are difficult to move. Any sudden movement of the cup may cause the contents of the cup to spill and burn the hand of the person holding the cup. The prior art record is replete with numerous lids and covers designed to fit over hot beverage cups and prevent the contents of the cup from spilling. Such cup lids are commonplace at fast food establishments and are exemplified by U.S. Pat. No. 5,197,624 to Dodaro, entitled CUP LID. However, the use of such cup lids presents an obstacle to those who would like to use their coffee or tea to warm and moisten their pastry. A typical prior art disposable cup lid only has a small opening through which a person may sip the beverage. This small opening is too small for the purpose of exposing a significant amount of a pastry to the beverage's steam. As a result, even though the use of a lid prevents spillage of the beverage and prevents a pastry from falling into the cup, it also prevents the benefits sought.

One method of obtaining some of the benefits of a lid while still allowing a pastry to be heated and moistened, is by using a perforated lid on the hot beverage cup. A perforated lid prevents the pastry from falling into the cup, while it enables heat and steam to contact the pastry. The problem with prior art perforated lids is that once a person takes a sip of the beverage through the lid, some liquid inevitably becomes trapped on the surface of the lid. This liquid does not flow back into the cup through the perforations due to the surface tension of the fluid and/or depressions present between perforations on the lid.

A typical prior art perforated lid is shown in U.S. Pat. No. 4,331,255 to Fournier, entitled CUP COVER. In this patent, a perforated lid is used as a splash guard that regulates the flow of fluid through the lid. Such a perforated lid cannot be used to support a pastry because it is specifically designed to retain liquid between itself and the outer lid as the beverage is drunk. As such, the perforated lid will inevitably be wet and will make a pastry soggy.

It is therefore an objective of the present invention to provide a cup lid capable of supporting a pastry above the contents of the cup in such a manner that the pastry is kept warm and moist by the steam rising from the cup, yet the pastry is kept out of contact with the liquid in the cup, even when a person is drinking from the cup.

It is a further objective of the present invention to provide a cup lid with a perforated cover and a solid cover wherein the solid cover matches the contours of the perforated cover, thereby preventing liquid from collecting between the two covers.

SUMMARY OF THE INVENTION

The present invention is a lid for a disposable hot beverage container that is specifically designed to support a pastry over the hot beverage. This enables the steam from the beverage to heat, flavor and moisten the pastry. The present invention lid includes an engagement mechanism that enables the lid to be selectively joined to the rim of the hot beverage container. The lid has a plurality of apertures formed through its base structure that enable steam from the beverage to rise through the lid. A plurality of supports extend upwardly from the base structure. The supports all terminate in a common plane a predetermined height above the base structure. The supports hold the pastry a predetermined distance above the base structure of the lid. As a result, if liquid were to spill onto the lid, or if steam were to condense onto the lid, the pastry would be supported above the liquid and would be saved from becoming soggy.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be used to support any object over a container, such as a paint brush over a container of paint, the present invention is especially suited for supporting a pastry over a disposable hot beverage cup. Accordingly, the present invention will be described in connection with supporting a donut over a disposable coffee cup in order to set forth the best mode contemplated for the invention.

Figure 1:
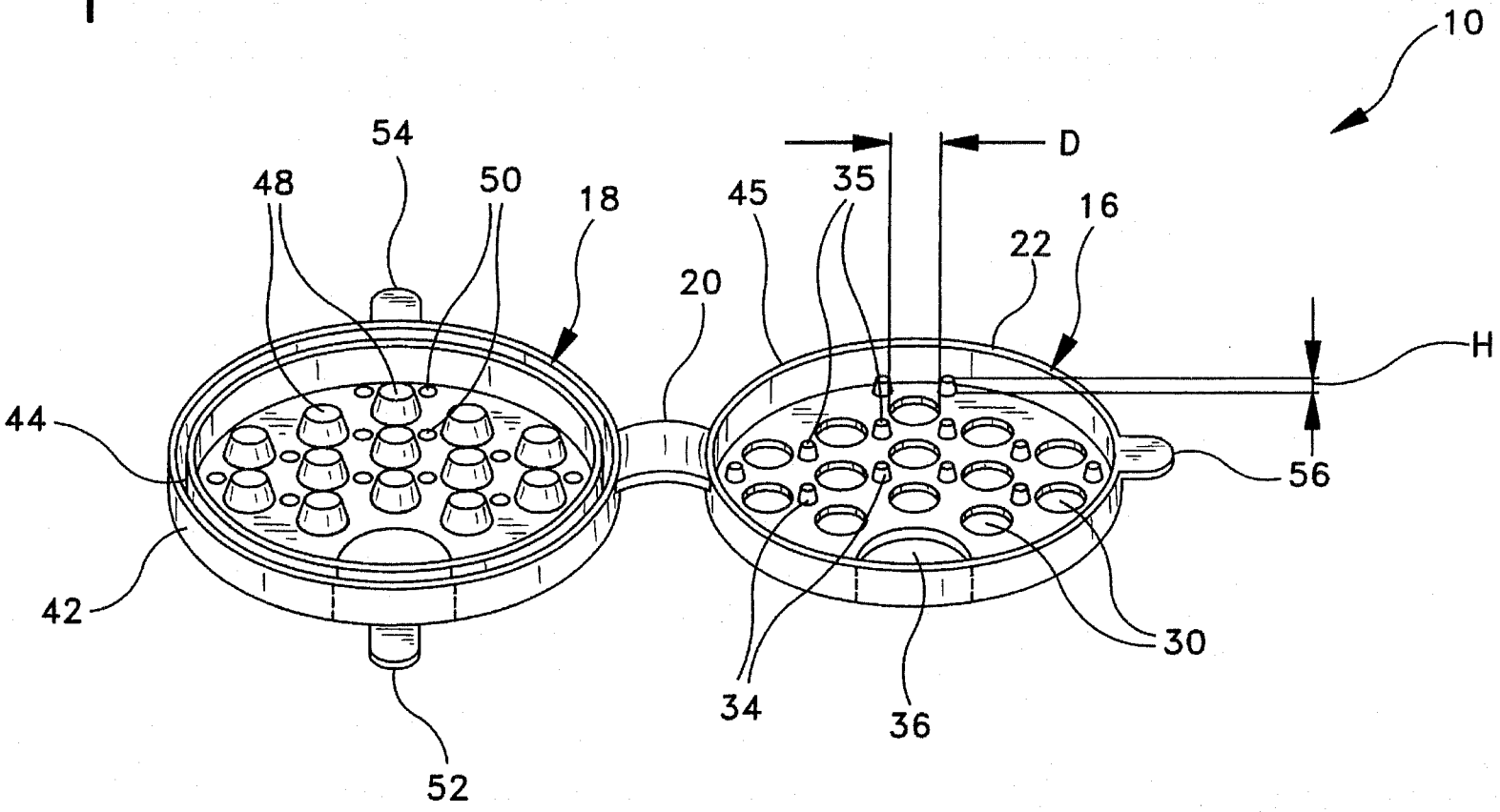
FIG. 1 is a perspective view of one preferred embodiment of the present invention cup lid.
Figure 2:
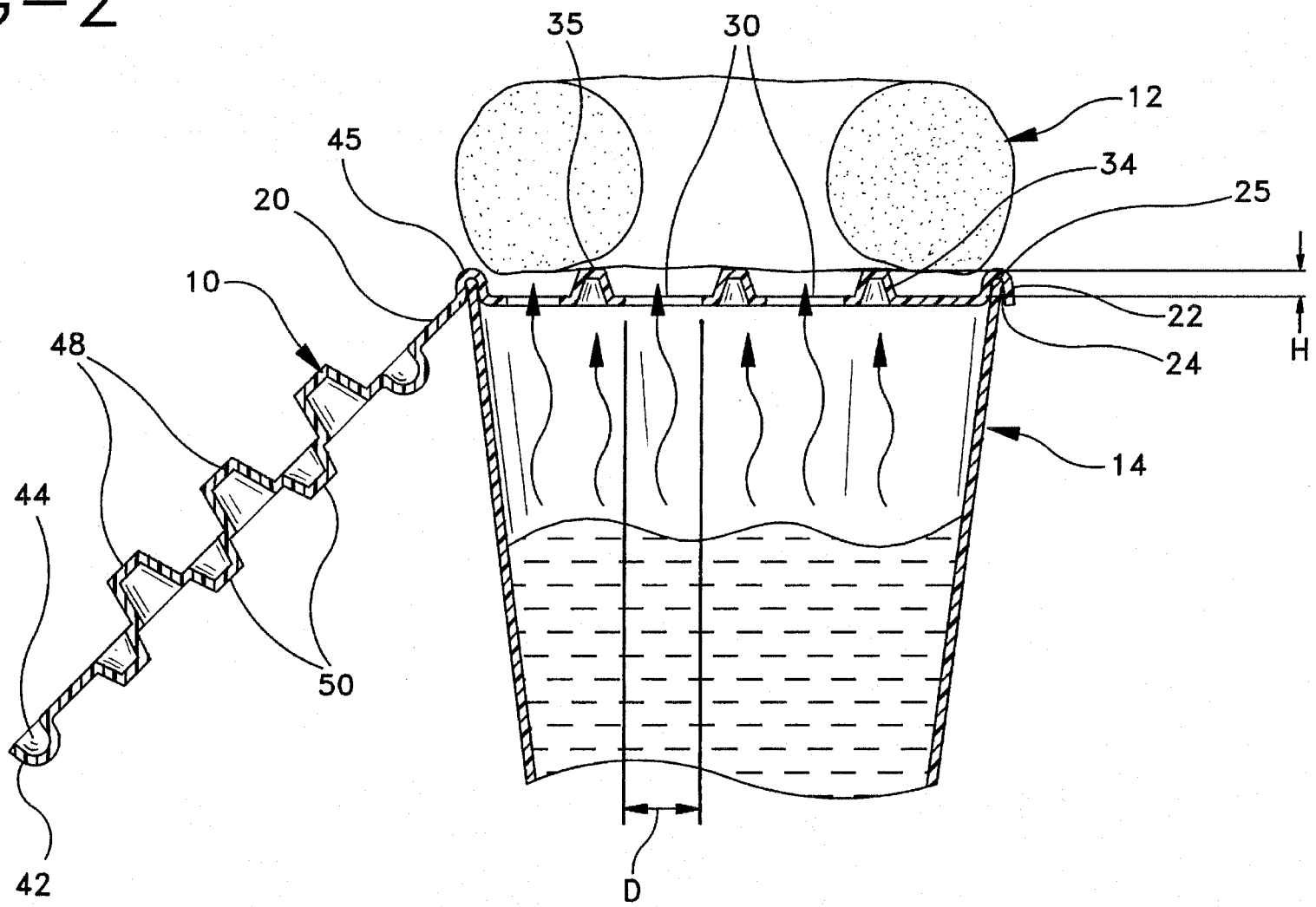
FIG. 2 is a cross-sectional view of the embodiment of FIG. 1, shown in conjunction with a disposable coffee cup and a donut to facilitate consideration and discussion.

Referring to FIGS. 1 and 2, a preferred embodiment of the present invention cup lid 10 is shown. In FIG. 2, the cup lid is shown in conjunction with a donut 12 and a typical disposable coffee cup 14, such as those served at fast food franchise restaurants. The cup lid 10 is shown as a two element structure having a perforated cover 16 joined to a solid cover 18 by a living hinge 20. In the shown embodiment, the perforated cover 16 and the solid cover 18 are unistructurally molded but it should be understood that these two elements need not be attached, but rather could be separately manufactured and used.

The perforated cover 16 has a rim 22 with a generally U-shaped channel 24 that engages the rim 25 of the coffee cup 14 in a typical prior art fashion. A plurality of large apertures 30 are formed through the perforated cover 16. Each of the apertures 30 has a diameter D preferably between 5 mm and 20 mm, although other dimensions can be used. The apertures 30 are arranged on the perforated cover 16 so that the combined area of the apertures 30 is between 20% and 60% of the entire surface area defined by the periphery of the perforated cover 16.

A plurality of pastry supports 34 extend upwardly from the perforated cover 16. In a preferred embodiment, the pastry supports 34 extend a height H of between 1 mm and 7 mm over the plane of the apertures 30. Each of the pastry supports 34 has a narrow flat top surface 35 that terminates in a common plane so as to provide an even support surface for the donut 12.

A semicircular opening 36 (FIG. 1) is formed at one edge of the perforated cover 16. As will later be explained, the opening 36 enables a person to drink from the coffee cup 14 even though the perforated cover 16 and/or solid cover 18 are in place.

For reasons which will later be explained, the solid cover 18 is essentially a negative image of the perforated cover 16. The solid cover 18 has a rim 42 with a generally U-shaped channel 44 capable of engaging the top surface 45 of the perforated cover's rim 22, thereby creating a generally fluid impervious seal between the solid cover 18 and the perforated cover 16. A plurality of plugging protrusions 48 extend from the solid cover 18. The plugging protrusions 48 correspond in number and position to the apertures 30 formed on the perforated cover 16. The size of the plugging protrusions 48 also corresponds to the size of the apertures 30 so that the plugging protrusions 48 pass into and obstruct the apertures 30 when the solid cover 18 is placed upon the perforated cover 16.

A plurality of indents 50 descend into the solid cover 18. The indents 50 correspond in number and position to the pastry supports 34 formed on the perforated cover 16. The size of the indents 50 also corresponds to the size of the pastry supports 34. As a result, when the solid cover 18 is placed upon the perforated cover 16, little empty space is present in between the indents 50 on the solid cover 18 and the pastry supports 34 on the perforated cover 16.

A tear away tab 52 (FIG. 1) is formed as part of the solid cover 18. The tear away tab 52 pulls away from the solid cover 18, thereby exposing an opening through which a person may drink. The tear away tab 52 is positioned directly above the semicircular opening 36 (FIG. 1) of the perforated cover 18, thereby providing an unobstructed opening for drinking. The structure and shape of many tear away tabs are well known in the prior art and need not be set forth in detail herein.

A pull tab 54 (FIG. 1) radially extends from the rim 42 of the solid cover 18. A similar pull tab 56 (FIG. 1) extends from the rim 22 of the perforated cover 16. The radial position of the solid cover pull tab 54 is different from that of the perforated cover pull tab 56 to facilitate the separate engagement of either the perforated cover 16 or the solid cover 18 by a person using the present invention lid 10.

Referring solely to FIG. 2, it can be seen that by placing the present invention cup lid 10 on a cup 14 of hot coffee, a support is made for the donut 12 wherein the heat and steam from the coffee is allowed to heat and moisten the donut 12. The steam from the coffee rises through the many large apertures 30 in the perforated cover 16. Since the apertures 30 preferably take up between 20% and 60% of the surface area defined by the periphery of the perforated cover 16, a large percentage of the donut 12 is exposed to the heat and moisture rising from the coffee. Since no one aperture 30 is very large compared to the size of the donut, there is no manner for the donut 12 to fall through the apertures 30 and into the coffee.

As the donut 12 rests on the perforated cover 16, the donut 12 does not reach the plane of the apertures 30. Rather, the donut 12 is supported a height H above the plane of the apertures 30 by pastry supports 34. The donut 12 rests upon the narrow, flat top surfaces 35 of pastry supports 34. As a result, should any liquid spill onto the top surface of the perforated cover 16, the donut 12 will be supported above the level of the liquid and the donut will not become soggy. Furthermore, by supporting the donut 12 a height H above the apertures 30, the steam rising from the coffee is provided an avenue of escape to the surrounding ambient atmosphere. This prevents excess steam condensation on the donut 12, thereby allowing the donut 12 to become moist but not soggy.

Figure 3:
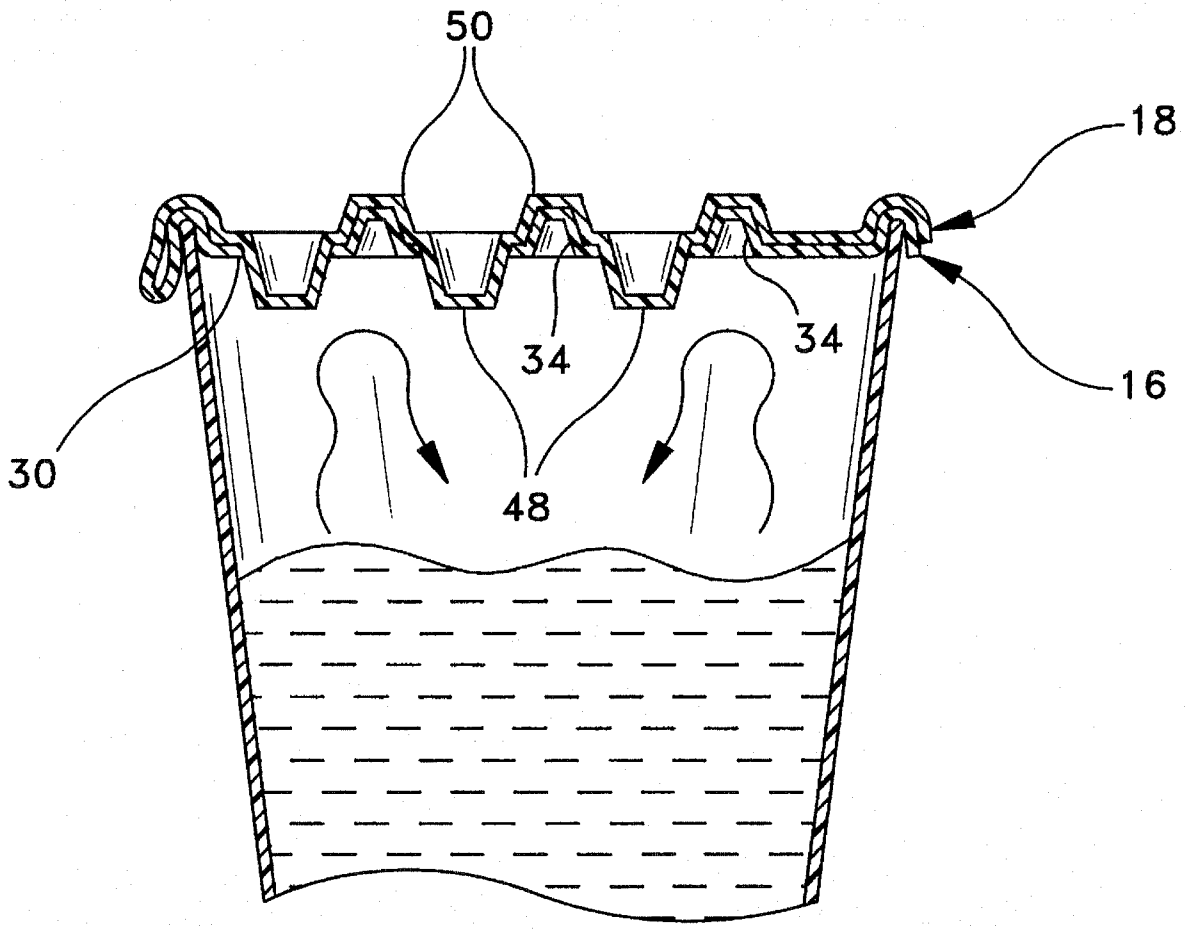
FIG. 3 is a cross-sectional view of the embodiment of FIG. 1, wherein the two sections of the invention have been reoriented into a closed configuration.

Referring to FIG. 3, it can be seen that as the solid cover 18 is placed over the perforated cover 16, the contours of the two covers match thereby minimizing the available space in between the solid cover 18 and the perforated cover 16. As the solid cover 18 is placed over the perforated cover 16, the plugging protrusions 48 pass into and obstruct the apertures 30 on the perforated cover 16. As a result, when the cup 14 is moved, the coffee is prevented from passing through the apertures 30 and into any space available above the perforated cover 16. Similarly, the pastry supports 34 on the perforated cover 16 pass into the indents 50 on the solid cover 18 to further limit the space available in between the two covers. Since the space in between the perforated cover 16 and the solid cover 18 is minimized, very little room is available for any liquid that spills into this region.

With the solid cover 18 positioned over the perforated cover 16, the tear away tab 52 (FIG. 1) of the solid cover 18 overlays the semicircular opening 36 (FIG. 1) on the perforated cover 16. As such, when the tear away tab 52 is removed, direct access can be had to the contents of the cup 14 via the semicircular opening 36. This enables a person to drink from the cup 14 when the cup lid 10 is not being used to support a pastry.

Figure 4:
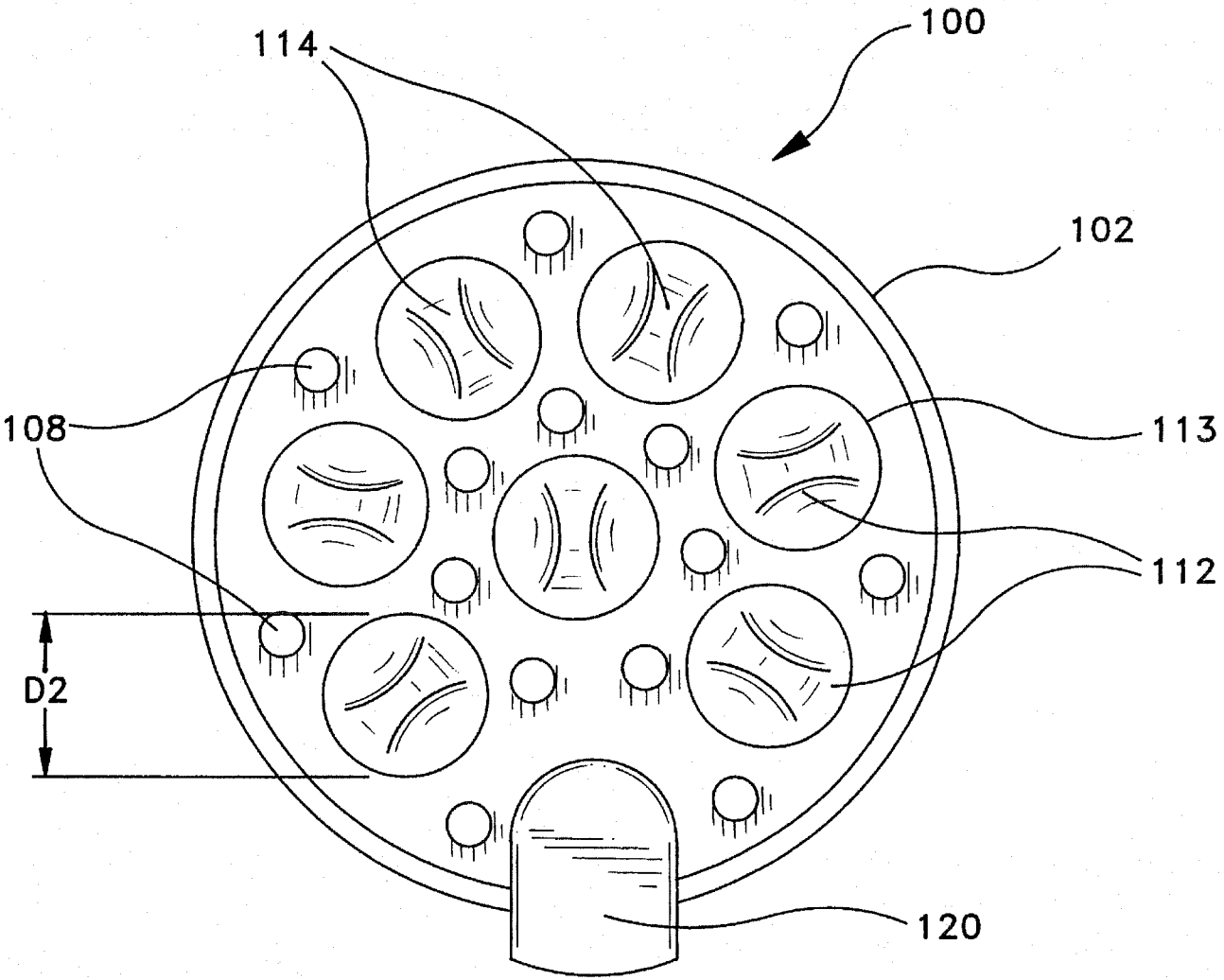
FIG. 4 is a top view of an alternate embodiment of the present invention cup lid.
Figure 5:
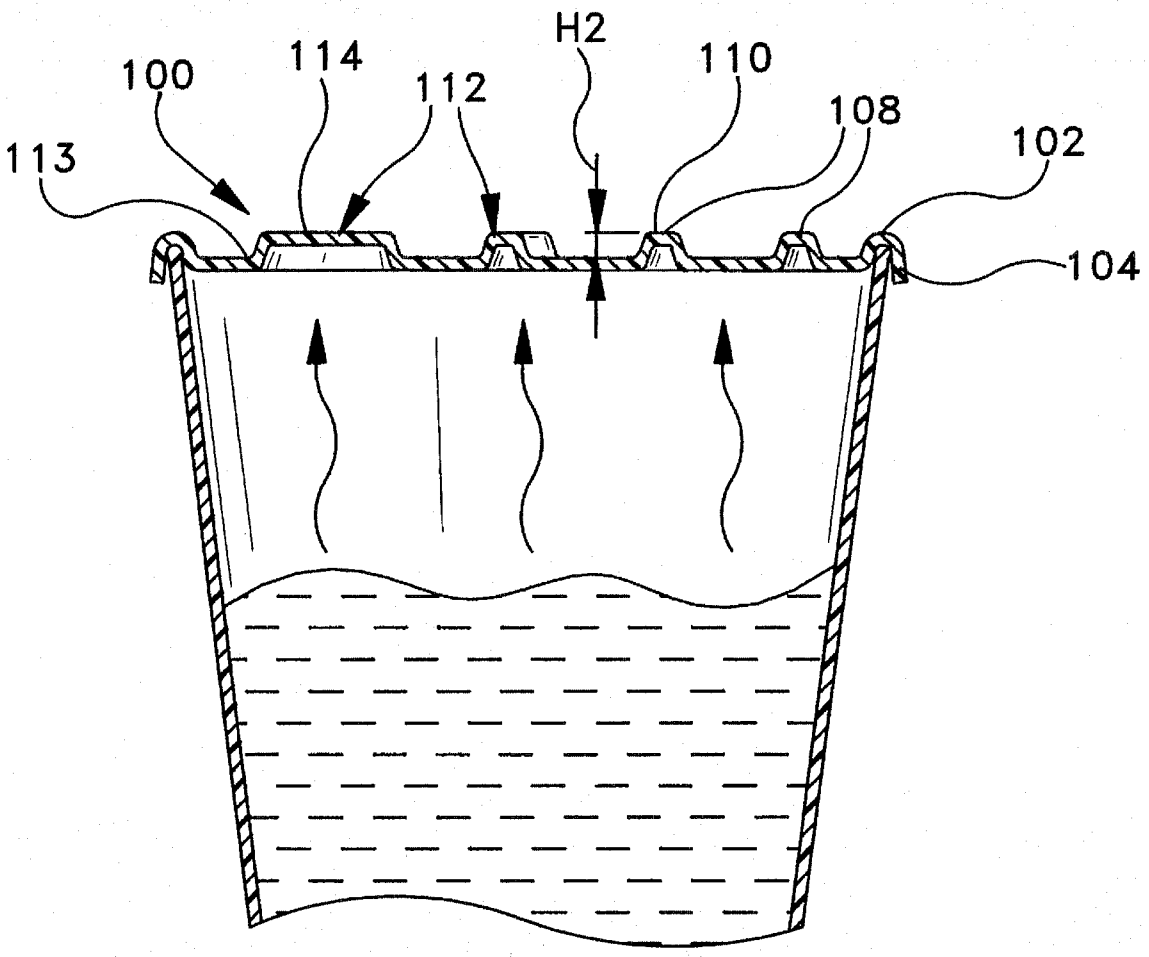
FIG. 5 is a cross-sectional view of the embodiment of FIG. 4, viewed along section line 5—5 and shown in conjunction with a disposable coffee cup.

Referring to FIGS. 4 and 5, an alternate embodiment of the present invention cup lid 100 is shown. In this embodiment, the cup lid 100 is a single piece unit that can be used as either a solid cover or a perforated cover, depending upon the needs of the user. The lid 100 has a rim 102 that defines a U-shaped channel 104. This enables the lid 100 to engage the rim of a disposable coffee cup in a conventional manner.

A plurality of pastry supports 108 protrude upwardly from the lid 100. As with the previous embodiment, the pastry supports 108 have flat top surfaces 110 that support a donut or other pastry a predetermined height H2 above the primary plane of the lid. By supporting a pastry above the primary plane of the lid, the pastry is held above any liquid that may be present on top of the lid 100.

A plurality of circular pinch tabs 112 are manufactured as part of the lid 100. Each pinch tab 112 has a scored periphery 113 that enables the pinch tabs 112 to be easily removed from the lid 100. Each pinch tab 112 has a pinching nub 114 extending upwardly from its top surface. To remove a pinch tab 112, a person grasps the pinching nub 114 between two fingers and applies a pinching force in the directions of the arrows 115. The pinching force compresses the pinch tab 112 and severs the scored periphery of the pinch tab 112, thereby allowing the pinch tab 112 to be removed from the lid 100. Since multiple pinch tabs 112 are present on the lid 100, it will be understood that any or all of the pinch tabs 112 can be removed as desired.

The pinch tabs 112 are preferably circular with a diameter D2 of between 1 cm and 2.5 cm, although other dimensions can be used. The pinch tabs 112 are arranged so that the combined area of the pinch tabs 112 is between 20% and 60% of the surface area defined by the periphery of the lid.

When the pinch tabs 112 are removed, heat and steam from the coffee in the cup is allowed to heat and moisten a pastry placed upon the lid 100. However, if a person was not eating a pastry, the pinch tabs 112 could be left in place. As a result, the present invention lid 100 would act as a typical prior art cup cover, allowing access to the contents of the cup only through a removable drinking tab 120.

It should be understood that the embodiments of the present invention described above are merely exemplary and many equivalent components, constructions and configurations could be used to fashion the invention. All such modifications, variations and alternate embodiments are intended to be included as part of the present invention as defined by the following claims.

What is claimed is:

1. A cover for a container, comprising:

a base surface having a peripheral edge;

engagement means disposed on said peripheral edge for engaging the container and selectively joining the cover to the container;

a removable drinking tab disposed on said base surface, wherein said removable drinking tab is selectively removable to expose an opening in said cover large enough for drinking;

at least four apertures disposed in said base surface, wherein said apertures are substantially evenly distributed across said base surface; and a plurality of supports extending from said base surface, wherein said supports terminate in a plane a predetermined height above said base surface and are substantially evenly distributed across said base surface.

2. The cover according to claim 1, wherein said cover extends across a predetermined surface area and said apertures have a combined area that is between 20% and 60% of said predetermined surface area.

3. The cover according to claim 1, further including a removable means for selectively obstructing said apertures.

4. The cover according to claim 1, wherein said apertures are closed in a generally fluid impervious manner by a corresponding plurality of removable tabs.

5. The cover according to claim 1, further including a lid member positionable over said base surface and said plurality of supports, wherein said lid member creates a generally liquid impervious seal over the container.

6. The cover according to claim 5, wherein said lid member includes a plurality of protrusions that pass into and obstruct said apertures.

7. The cover according to claim 6, wherein said plurality of supports extending from said base surface create a given contour and said lid member has a corresponding contour that minimizes space between said lid member and said base surface when said lid member is placed over said base surface.

8. The cover according to claim 1, wherein said base surface defines several apertures that are substantially evenly distributed across said base surface, and several supports extend upwardly from said base surface, wherein said supports are substantially evenly distributed across said base surface.

9. The cover according to claim 1, wherein said predetermined height is between 1 mm and 7 mm.

10. The cover according to claim 3, wherein said removable means is a pinch tab unistructurally formed as part of said cover, wherein each said pinch tab can be selectively removed from said cover by a tactile manipulation.

11. A cover for a cup, comprising:

a base surface defined by a peripheral edge;

attachment means proximate said peripheral edge for attaching said cover to a cup;

at least four removable tabs disposed in said base surface and substantially evenly distributed across said base surface, wherein said removable tabs can be selectively removed to create apertures in said base surface; and a plurality of supports extending from said base surface, wherein said supports terminate in a plane a predetermined height above said base surface and are substantially evenly distributed across said base surface.

12. The cover according to claim 11, further including a plurality of supports extending from said base surface, wherein said supports terminate in a common plane a predetermined height above said base surface.

13. The cover according to claim 11, wherein said cover extends across a predetermined surface area and said removable tabs cover apertures that have a combined area that is between 20% and 60% of said predetermined surface area.

14. The cover according to claim 11, wherein said removable tabs are unistructurally molded as part of said cover having scored edges that enable each of said removable tabs to be manually removed.

15. A cover assembly for a container, containing:

a perforated lid having a base surface with at least four apertures thereon and a plurality of supports extending from said base surface wherein said supports terminate in a common plane a predetermined height above said base surface and are substantially evenly distributed on said base surface; and a solid lid positionable over said perforated lid so as to form a generally fluid impervious seal over said perforated lid, said lid having at least four protrusions thereon that extend into said at least four apertures and a plurality of reliefs sized to receive said plurality of supports when said solid lid is positioned over said perforated lid.

16. The cover assembly according to claim 15, wherein a pull tab is disposed on said solid lid, said pull tab covering a drinking aperture.

17. The cover assembly according to claim 15 wherein said apertures in said base surface have a combined area that is between 20% and 60% of the area covered by said perforated lid.

* * * * *